US006505366B1

(12) United States Patent
Lied

(10) Patent No.: US 6,505,366 B1
(45) Date of Patent: Jan. 14, 2003

(54) ADJUSTABLE SUPPORTING DEVICE, INTENDED FOR A PREMATURE INFANT IN AN INCUBATOR

(76) Inventor: Kjersti B. Lied, Ekornrødveien 20, N-3713 Skien (NO)

( * ) Notice: Subject to any disclaimer, the term of this patent is extended or adjusted under 35 U.S.C. 154(b) by 0 days.

(21) Appl. No.: 09/744,217

(22) PCT Filed: Jul. 20, 1999

(86) PCT No.: PCT/NO99/00241

§ 371 (c)(1),
(2), (4) Date: Jan. 22, 2001

(87) PCT Pub. No.: WO00/07536

PCT Pub. Date: Feb. 17, 2000

(30) Foreign Application Priority Data

Jul. 22, 1998 (NO) ..... 19983381

(51) Int. Cl.[7] ..... A47C 27/10; A47G 9/06

(52) U.S. Cl. ..... 5/655; 5/425; 5/710; 5/932; 5/945

(58) Field of Search ..... 5/655, 644, 417, 5/424, 425, 427, 655.3, 654, 657.5, 706, 710, 932, 945, 715

(56) References Cited

U.S. PATENT DOCUMENTS

| | | | | | |
|---|---|---|---|---|---|
| 3,513,489 | A | * | 5/1970 | Miller et al. | 5/710 X |
| 3,619,825 | A | * | 11/1971 | Taub et al. | 5/945 X |
| 3,778,852 | A | * | 12/1973 | Penn et al. | 5/932 X |
| 3,787,907 | A | * | 1/1974 | Pennington et al. | 5/932 X |
| 3,795,021 | A | * | 3/1974 | Moniot | 5/644 |
| 3,918,110 | A | * | 11/1975 | Cantillo et al. | 5/932 X |
| 4,038,712 | A | * | 8/1977 | Miller | 5/932 X |
| 4,150,447 | A | * | 4/1979 | Miller | 5/932 X |
| 4,445,240 | A | * | 5/1984 | Voorhees | 5/654 X |
| 4,459,714 | A | * | 7/1984 | Lin | 5/710 X |
| 4,583,253 | A | * | 4/1986 | Hall | 5/424 X |
| 4,670,923 | A | * | 6/1987 | Gabriel et al. | 5/424 |
| D300,694 | S | * | 4/1989 | Krok | 5/655 |
| 4,905,332 | A | * | 3/1990 | Wang | 5/655.3 |
| 4,964,183 | A | * | 10/1990 | LaForce, Jr. | 5/710 X |
| 5,247,712 | A | * | 9/1993 | Williams | 4/585 |
| 5,421,044 | A | * | 6/1995 | Steensen | 5/710 |
| 5,699,569 | A | * | 12/1997 | Schwarz-Zohrer | 5/655 |
| 6,073,291 | A | * | 6/2000 | Davis | 5/715 X |
| 6,079,070 | A | * | 6/2000 | Flick | 5/715 |
| 6,154,900 | A | * | 12/2000 | Shaw | 5/715 X |
| 6,185,765 | B1 | * | 2/2001 | High | 5/710 X |
| 6,282,735 | B1 | * | 9/2001 | Stolpmann et al. | 5/606 |

FOREIGN PATENT DOCUMENTS

| | | | | |
|---|---|---|---|---|
| EP | 0 316 265 | | 5/1989 | |
| GB | 412245 | A * | 6/1934 | 5/655.3 |
| GB | 946831 | A * | 1/1964 | 5/715 |
| GB | 2 231 790 | | 11/1990 | |
| NO | 129279 | | 3/1974 | |

* cited by examiner

*Primary Examiner*—Robert G. Santos
(74) *Attorney, Agent, or Firm*—Young & Thompson

(57) ABSTRACT

An adjustable supporting device for a premature infant, comprising an inflatable base (1) consisting of two superimposed air and gas impermeable layers (5, 6), divided into at least two flat sections (2, 3), and running along the perephery of the base an inflatable wall (4), optionally also divided into two sections, wherein all base sections (2, 3) and wall (4) or wall sections are inflatable and pressure-adjustable independent of one another.

8 Claims, 1 Drawing Sheet

ADJUSTABLE SUPPORTING DEVICE, INTENDED FOR A PREMATURE INFANT IN AN INCUBATOR

Figure 1:
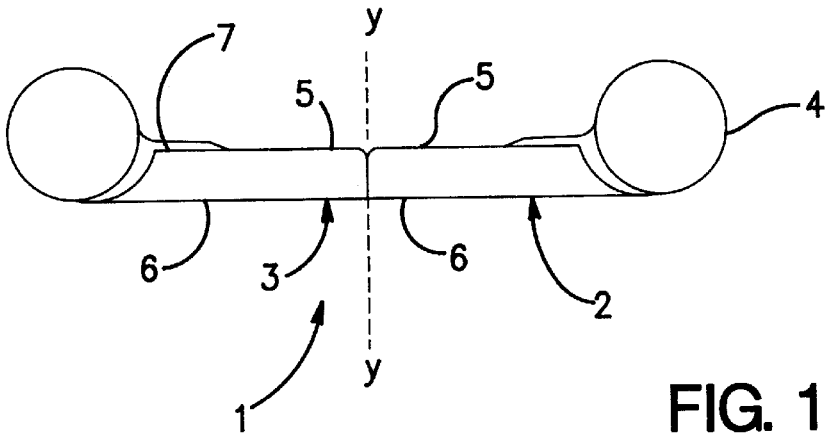

The present invention relates to an adjustable supporting device, especially intended for premature infants, that is, infants who are born too soon, in open and closed incubators.

However, the subject matter of the invention may also be used both in cots in premature wards in hospital and also in other wards such as medical, surgical and neurosurgical wards where there are infant patients, and the subject matter of the invention will also be suitable for home use.

The invention is based on the principle of separate inflatable sections or units wherein in addition the pressure can be adjusted individually.

Premature infants in need of incubator treatment belong to a highly vulnerable group of patients in need of extremely careful treatment.

A feature of this careful treatment is that the infants should be "handled" as little as possible when they are in an incubator or a cot.

The object of the subject matter of the present invention, an adjustable supporting device for such infants, is to solve this problem by providing a supporting device divided into at least two sections which can be inflated and pressure-adjusted individually, thereby allowing the infant's position to be changed without any direct manual contact.

A great number of devices are known, all of which aim to have a certain form of individual inflatability and pressure adjustment.

In this connection reference will made to DE-AS 1 012 737 which describes an air mattress of a known type per se, but wherein the tubular bodies which constitute the side edges and foot piece can be raised just above the vertical plane and joined together while obtaining a bed-like structure.

DE-PS 918 109 describes a mattress wherein the middle, inflatable sections can be turned 90° upwards relative to the outer inflatable section and wherein optionally there may in addition be placed inflatable cushions between the thus produced walls.

NO 129 279 describes a mattress-like structure which with the aid of transverse and longitudinal seams is divided into sections, and wherein side sections and end sections can be folded up to form a bed when the air is released from the sections located in the corners.

GB 1 602 952 described a supporting device consisting of a number of parallel, inflatable bodies, intended to extend transverse of a person resting on the supporting device and wherein each of these bodies can be filled with a fluid, and wherein each body has an upper part which can be emptied separately to provide an certain adjustment to the body contours.

GB 1 534 821 describes a device that is in principle the same as that in the aforementioned '952, but used in connection with a dentist's chair or the like.

Finally, NO 174 452 describes an individually adjustable cushion system wherein separately manipulatable cushions can via a manifold be brought to the desired pressure for placing individually under different parts of a patient.

The object of the subject matter of the present invention is to simplify the prior art whilst aiming to satisfy the needs of premature infants in connection with a supporting device.

As mentioned, the subject matter of the invention is intended to be used in incubators, but can of course be used in any other place, including domiciliary care.

Accordingly, the present invention relates to an adjustable supporting device, chiefly for premature infants, comprising an inflatable base, consisting of two superimposed air and gas impermeable layers, divided into at least two flat sections, and a circumferential, inflatable wall, optionally also divided into at least two sections, wherein all the base sections and wall or wall sections are inflatable and pressure-adjustable independent of one another.

Preferably, the wall is in one section and is in the shape of a circular sausage that forms a complete circle.

The premature supporting device of the invention preferably has a basic shape that is generally oval.

Although the base may be divided into any number of flat sections, it is in principle preferred that there be only two sections.

In order to prevent the infant lying on the supporting device from accidentally sliding so that a part of his or her body might perhaps be trapped between an inflated section and, for example, a base section in the process of being inflated, it is preferred that the supporting device be equipped with a sheet of cloth which on one side is fastened to the upper layer of the base and on the other side to the wall at about half way up the height thereof.

Figure 2:
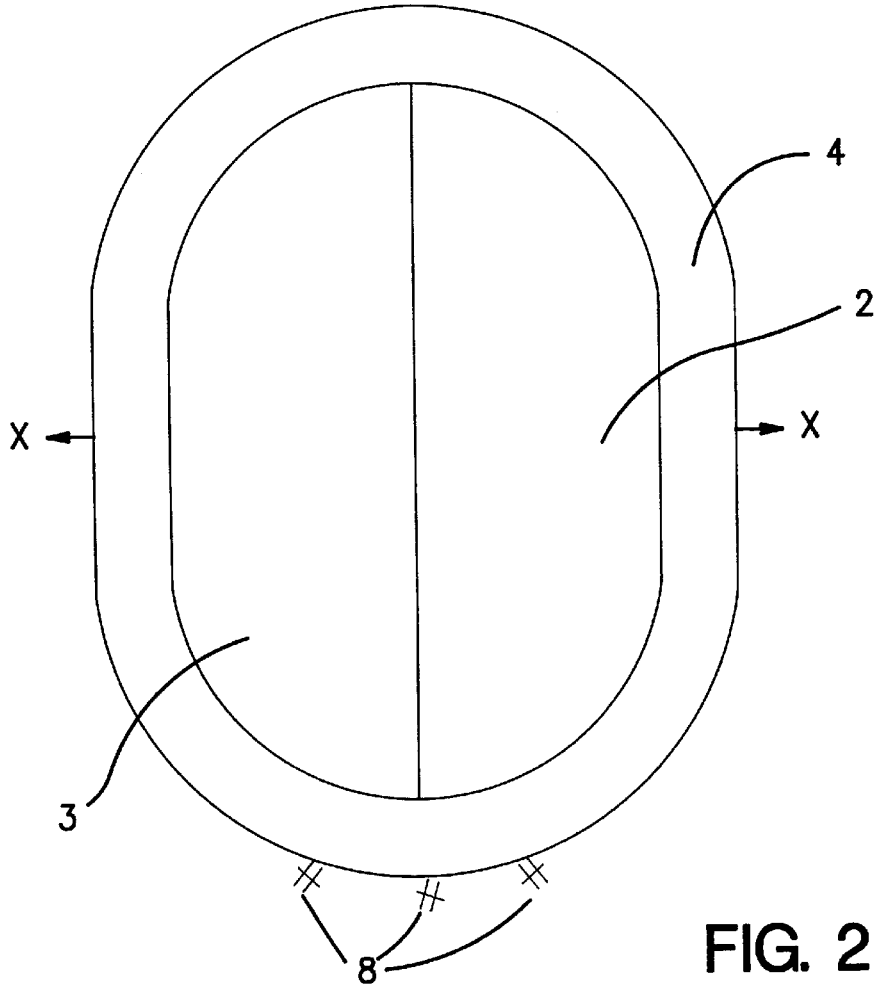

The invention will be described in more detail with reference to the accompanying drawings, wherein:

FIG. 1 shows a supporting device according to the invention along the line x—x in FIG. 2, although in two different embodiments, one on either side of the line y—y; and FIG. 2 shows the supporting device according to the invention in an embodiment seen from above.

According to the invention, the adjustable supporting device for premature infants comprises a base 1 which in the illustrated embodiment is divided into two flat sections 2 and 3.

Each flat section consists of two superimposed fluid-impermeable layers 5, 6 which in a suitable manner are welded along their periphery, thus enabling the sections to be inflated individually to the desired pressure.

Along the periphery of the base 1 runs a similarly inflatable wall 4, which in the illustrated embodiment has the form of a bead or sausage that forms a complete circle, but there is nothing to prevent this wall from also being divided into several sections.

In the embodiment shown on the right in FIG. 1, the upper layer 5 is welded to the lower layer 6 along the line indicated by y—y along the centre of the supporting device, whilst the layer 5 along the outer periphery is welded directly to the wall 4, the inflatable chamber thus being defined by the bottom layer 6, the top layer 5 and a part of the wall 4.

An alternative embodiment is shown on the left of FIG. 1, where the upper layer 5 is welded along the whole of its periphery to the essentially corresponding periphery of the bottom layer 6 whilst the wall 4 constitutes a separate unit.

In this embodiment there is a danger that the premature infant might become trapped between the inflated base 3 and the wall 4 and there is therefore provided a sheet of cloth or sheeting 7 which runs from the inner curve of the wall 4 and some way in on the inflated base 3, and is fastened to the top layer 5.

By manipulating the pressure in the different sections of the supporting device in an appropriate manner it is possible to change the infant's position in the supporting device in a gentle careful manner, thereby allowing the child's position to be changed in a gentle manner without manual manoeuvring so as to avoid static loads and the effect of handling.

The possibility of individual pressure adjustment in the different parts is indicated by the valve end pieces 8 in FIG. 2.

Of course, the product is made in a soft, skin-friendly and non-allergenic material with no sharp edges, seams or the like.

It may be an advantage that straps or handles be fastened to the base or the outside which allow a simple and safe movement of the actual 'nest' when the incubator is to be cleaned or in other cases when it is necessary to move the infant.

The adjustable supporting device according to the invention is also preferably made of a material that allows x-rays to be taken whilst the infant is in the supporting device.

The adjustable supporting device according to the invention makes possible a simplified working situation for the staff whilst the infant is given complete safety and maximum comfort on the basis of the given conditions.

What is claimed is:

1. An adjustable supporting device for a premature infant, comprising:

an inflatable base comprising two superimposed, air and gas impermeable layers, divided into at least two flat sections; and an inflatable wall running along a periphery of the base;

wherein all of the base sections and the wall are inflatable and pressure-adjustable independent of one another, and wherein an upper layer of the base along the periphery of the base is welded directly to the wall at about half way up a height of the wall.

2. A supporting device according to claim 1, wherein the wall is in one section and has a form of a circular sausage that forms a complete loop.

3. A supporting device according to claim 1, characterized in that the device has an oval basic shape.

4. A support device according to claim 1, wherein the base comprises two parts.

5. An adjustable supporting device for a premature infant, comprising:

an inflatable base comprising two superimposed, air and gas impermeable layers, divided into at least two flat sections; and an inflatable wall running along a periphery of the base, all of the base sections and the wall being inflatable and pressure-adjustable independent of one another, an upper layer of the base along the periphery of the base being welded to a lower layer of the base; and a catch layer which along one end is welded to the wall at about half way up a height of the wall, and along another side thereof is welded to the upper layer of the base.

6. A supporting device according to claim 5, wherein the wall is in one section and has a form of a circular sausage that forms a complete loop.

7. A supporting device according to claim 5, characterized in that the device has an oval basic shape.

8. A support device according to claim 5, wherein the base comprises two parts.

* * * * *